United States Patent [19]

Berg

[11] 4,087,299

[45] May 2, 1978

[54] METHOD AND APPARATUS FOR MANUFACTURING CYLINDRICAL TUBES

[75] Inventor: Rolf Berg, Djursholm, Sweden

[73] Assignee: Aktiebolaget Statens Skogsindustrier, Stockholm, Sweden

[21] Appl. No.: 742,154

[22] Filed: Nov. 15, 1976

Related U.S. Application Data

[63] Continuation of Ser. No. 557,846, Mar. 12, 1976, abandoned.

[51] Int. Cl.[2] ..... B65H 81/00

[52] U.S. Cl. ..... 156/192; 156/195; 156/429; 156/498

[58] Field of Search ..... 156/184–185, 156/187, 190, 191–192, 195, 428, 429, 498, 244; 229/4.5; 93/80, 94 R

[56] References Cited

U.S. PATENT DOCUMENTS

| | | | |
|---|---|---|---|
| 3,159,515 | 12/1964 | Dunlap | 229/4.5 X |
| 3,338,270 | 8/1967 | Denenberg | 156/185 X |
| 3,406,614 | 10/1968 | Martin et al. | 229/4.5 X |
| 3,457,130 | 7/1969 | Morrison | 156/195 X |
| 3,520,463 | 7/1970 | Ahlemeter | 229/4.5 |
| 3,563,826 | 2/1971 | O'Neal | 156/195 X |
| 3,846,202 | 11/1974 | Clarke | 156/195 X |

FOREIGN PATENT DOCUMENTS

| | | | |
|---|---|---|---|
| 842,032 | 5/1970 | Canada | 229/4.5 |

*Primary Examiner*—David A. Simmons

*Attorney, Agent, or Firm*—Sughrue, Rothwell, Mion, Zinn and Macpeak

[57] ABSTRACT

The present invention relates to a method of manufacturing from paper and other similar fibrous materials cylindrical tubes comprising an inner, dense, liquid-tight plastics foil layer, in which method at least one paper web and a plastics foil web are wound helically together on a rotating mandril with the plastics foil web located against the forming surface of the mandril, and in which the plastics foil web is bonded to the paper web by means of an adhesive. The invention also relates to an apparatus for carrying out the method.

6 Claims, 4 Drawing Figures

METHOD AND APPARATUS FOR MANUFACTURING CYLINDRICAL TUBES

This is a continuation, of application Ser. No. 557,846, filed Mar. 12, 1976, now abandoned.

BACKGROUND OF THE INVENTION

In the present day continuous manufacture of tubes comprising an inner, dense laminar layer and one or more layers of fibrous material for example a kraft liner located externally on said laminar layer, said layer of fibrous material being generally referred to hereinafter as a "paper layer", there is used a liquid binding agent to bond said layers, which are helically wound together one on top of the other. This bonding technique greatly restricts the possibility of using high density plastics, for example high density polyethylene, as the liquid-tight layer in the interior of the tube.

The manufactured tubes, which are cut into smaller tubes to form container preforms and which are provided with a lid and a bottom member, are relatively expensive to manufacture when liquid adhesives are used, since a great deal of energy is expended in drying the adhesive, and when a plurality of paper layers are used, which is common practice so as to obtain sufficient form stability with respect to the tube, the amount of energy consumed is unproportionally high. When the adhesive is allowed to dry naturally, it has been found that the layers tend to separate.

SUMMARY OF THE INVENTION

An object of the present invention is to provide a method and an apparatus for the continuous manufacture of tubes in which the use of "wet" adhesives can be totally avoided and in which the energy consumed to produce a reliable and permanent bonding of the layers is at a minimum, and in which the tube is ready for use immediately it leaves the forming mandril.

A further object of the invention is to provide a method and an apparatus for the manufacture of tubes having an internal plastics layer which is resistent to oil and grease and similar products, this requiring a plastics laminar of very high density.

In one aspect, this invention consists in a method of manufacturing cylindrical tubes in which a plastics foil web and at least one paper web are wound helically on a rotating mandril and in which the side of the paper web adjacent the plastics foil web is coated with a softenable plastics substance which becomes tacky when heated, and in which said paper web is moved past a heat source arranged to soften the plastics substance to said tacky state, whereafter the plastics foil web is brought into contact with the tacky surface of said paper web in a manner such that said edge portion of the plastics foil web projects at a substantially constant width outside one side edge of the paper web, wherein the laminar web formed by the plastics foil web and the paper web is fed to the mandril with the plastics foil web in contact with the forming surface of the mandril, wherein said edge portion of the plastics foil web is provided with a continuous coating of molten adhesive on the side thereof remote from the said forming surface, wherein windin of said paper web and said plastics foil web on said mandril is effected at such an angle that the edge portion is contacted with the second edge portion of said plastics foil web, and wherein said mandril is cooled during said winding process so as to solidify said molten adhesive.

In another aspect, the invention consists in an apparatus for carrying out said method, said apparatus comrpising first guide means for guiding a plastics foil web to a rotatable, driven mandril, and second guide means for guiding a paper web to said mandril, one surface of said paper web being provided with a layer of softenable plastics material which becomes tacky when heated, said first and second guide means and said mandril being so adjusted in relation to each other that the plastics foil web and the paper web are placed in superposed relationship and wound helically on said mandril with the plastics foil web adjacent the forming surface of this mandril and with a side edge portion of the plastics foil web located outside an adjacent side edge of the paper web; and heating means located between said first and said second guide means for heating the softenable plastics material on said paper web to a tacky state, wherein said apparatus further comprises press means for taking up the paper web and the plastics foil web and for pressing the tacky surface of said paper web against said plastics foil web; adhesive supply means arranged to provide a string of molten adhesive to said edge portion on the mandril; and means for cooling the forming surface of said mandril.

BRIEF DESCRIPTION OF THE DRAWINGS

So that the invention will be more readily understood and further features thereof made apparent, an embodiment of the invention will now be described with reference to the accompanying drawings, in which.

DESCRIPTION OF THE PREFERRED EMBODIMENT

Figure 1:
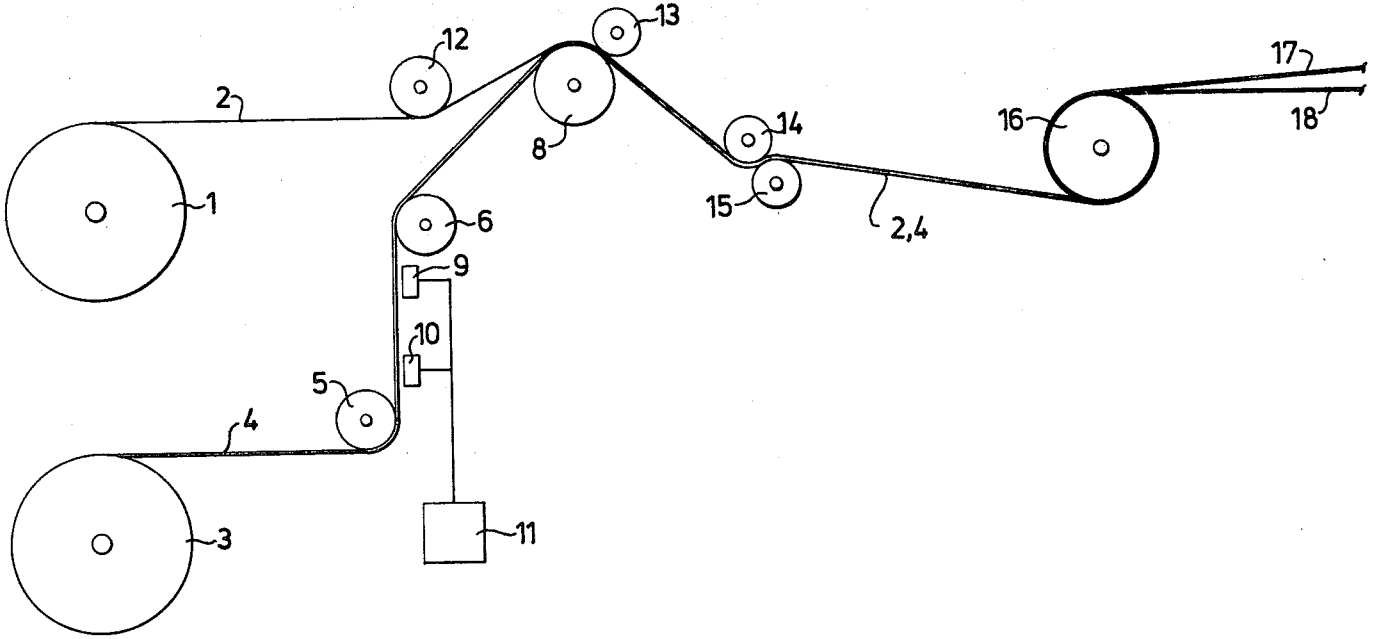
FIG. 1 shows diagrammatically and in a simplified manner the major components of an apparatus according to the invention.

In FIG. 1 there is shown a storage reel 1 carrying a plastics laminar web 2, for example a web of high density polyethylene. Also provided is a storage reel 3 containing a paper web 4, for example a kraft liner. The side of the paper web 4 remote from the centre of the storage reel 3 is provided with a layer of plastics material, for example a layer of high density polyethylene. The paper web 4 is arranged to pass from the storage reel 3, over a free-moving guide roller 5 to a further free-moving guide roller 6, from where it passes to a further free-moving guide roller 8. With the illustrated embodiment there is arranged between the two guide rollers 5 and 6, two heating elements 9 and 10 which operate in conjunction with an energy source 11. The heating elements 9 and 10 may comprise electric resistance elements which are heated to red heat, or, for example, gas burners. Heat is uniformly applied to the surface of the paper web 4 facing the elements 9 and 10 to bring the plastics layer located on the other side of the paper web to a tacky state. When the plastics layer comprises a high density polyethylene, said layer should be heated to a temperature of approximately 150° C.

Figure 3:
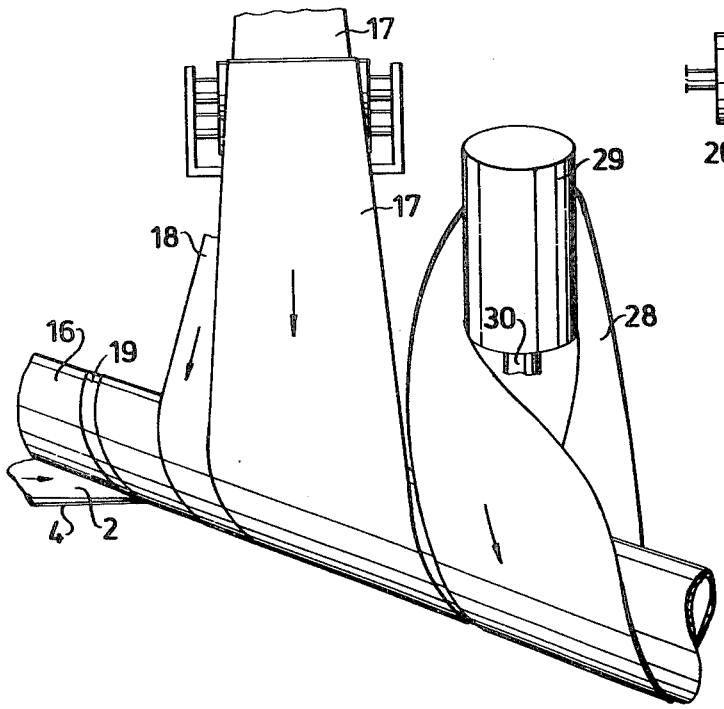
FIG. 3 shows diagrammatically part of said mandril and a press belt for pressing the webs wound on the mandril together.

The plastics laminar web 2, which is preferably at room temperature, is passed beneath a freely rotating guide roller 12 and is brought together with the paper web 4 on the guide roller 8. Since the surface of the paper web 4 facing the plastics laminate web is tacky, the two webs 2 and 4 will bond together, and to ensure good bonding between said webs there is provided a pressure roller 13 which is arranged to co-act with the guide roller 8 to press the two webs 2 and 4 together. The combined webs 2 and 4 are then passed between two pressure rollers 14 and 15 to a mandril 16 which is driven by means of conventional drive means (not shown). The webs 2 and 4 are drawn through the apparatus from their respective supply reels 1 and 3 and are wound helically on the mandril 16 in a known manner. With the illustrated embodiment the helically wound webs 2 and 4 on the mandril 16 are provided with two additional paper webs 17, 18. As best seen in FIG. 3, the two additional paper webs 17 and 18 are wound helically on the tube formed by the webs 2 and 3 on the mandril 16. The paper webs 17 and 18 are similar to the paper web 4, i.e., the side of the web 17 and the web 18 facing the mandril 16 is coated with a layer of plastics material which becomes tacky when heated by means of heating devices, (not shown), said heating devices being preferably of the same type as the heating devices 9 and 10.

Figure 2:
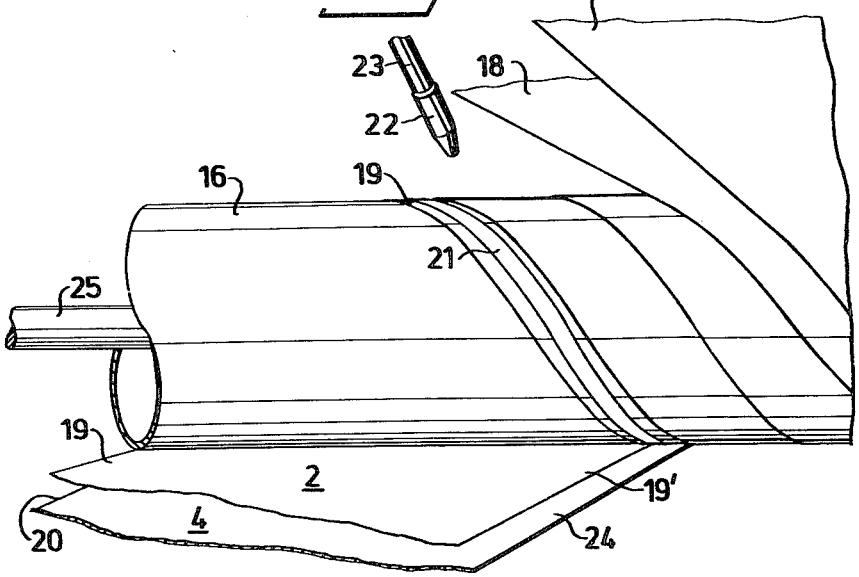
FIG. 2 shows diagrammatically part of the mandril on which the different webs are wound.

As will be seen from FIG. 2, the plastics laminar web is displaced relative to the paper web 4 on the mandril 6 in a manner such that an edge portion 19 of substantially uniform width projects outside one side edge 20 of the paper web. The edge portion 19 of the plastics laminar web 2 lies freely on the rotating mandril 16, as shown.

A string or bead of molten adhesive 21 is applied to the edge portion 19 on the mandril 16 by means of an adhesive supply device 22, which is shown in simplified form in FIG. 2 and which is arranged to supply molten adhesive via a line 23 from a source (not shown).

It should be observed that with the embodiment of FIG. 2 it is presumed that the two webs 2 and 4 have the same width and that because the edge portion 19 projects outside the one edge surface of the paper web 4 an edge portion of corresponding width will be exposed on the opposite side of the paper web 4. If desired, however, the width of the plastics laminar web 2 may be such that the whole of the web 4 is covered.

As the mandril 16 rotates the edge portion 19 with the string of adhesive 21 applied thereto is contacted with the edge portion 24 of the combined web 2, 4 and the edge portion 19' of the web 2, thereby to provide a joint which is completely liquid-proof.

To provide a reliable bond between the molten adhesive 21 and the plastics laminar web 19, particularly when a high density plastics material is used, the adhesive must have a temperature in the region of 150° C, which involves the risk of melting or burning the edge portion 19. To eliminate this risk and to provide for the rapid solidification of the molten adhesive, the mandril 16 must be cooled whereby at least the plastice laminar layer located nearest the forming surface of the mandril is maintained at a temperature which excludes the risk of burning and melting. As will be seen from FIG. 2, to this end the mandril 16 of the illustrated embodiment is of hollow construction and cooling air or some other appropriate cooling medium is passed to the interior of the mandril via a line 25 from a source of cooling medium (not shown). With a plastics laminar web thickness of approximately 50 μm, a surface temperature of the mandril 16 of about 6° to 12° C must be maintained in order to maintain the edge portion 19 of the plastics laminar web on the mandril at a temperature of about 80° to 90° C.

Figure 4:
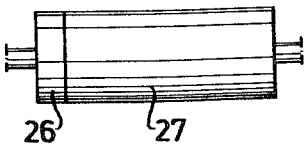
FIG. 4 shows a guide roller.

The temperature of the paper web 4 when it is joined with the plastics laminar web 2 at the guide roller 8 is in the region of 150° C and it has been found that if the temperature of the edge portion 19 is permitted to rise to a temperature in the region of 80° – 90° C, the combined webs are liable to be deformed in the transverse direction thereof. Heat must therefore be conducted away from said edge portion when a high density plastics material is used. In FIG. 4 there is shown a guide roller which comprises two materials having a mutually different thermal conductivity.

The portion 26 of the roller against which the edge portion rests during its movement between the position where the two webs 2, 4 are combined and the mandril 16 is accordingly made of, for example, steel, while the portion 27 which carries the mutually covering portions of the two webs is made, for example, of aluminium. Thus, no undesirable cooling of the paper web takes place, but that said web retains it high temperature and thus ensures a good bond between the two webs 2 and 4.

In FIG. 3 there is shown diagrammatically and in simplified form a press means which comprises an endless belt 28 which extends around the manufactured tube and presses the webs 2, 4, 18, 17 against each other during hardening of the heated plastics layers on the paper webs and the molten adhesive. The belt 28 is driven from a rotating drum 29 which is vertically mounted on a driven shaft 30. The drum 29 is movable towards and away from the mandril 16 by means not shown, for regulating the pressure exerted by said belt.

Although the invention has been described with reference to an embodiment thereof, the invention is not restricted to said embodiment, but can be modified within the scope of the claims. For example the guide rollers 14 and 15 can be ommitted from the illustrated apparatus and the belt 28 can be replaced with another pressure exerting means, for example, pressure rollers arranged to co-act with the mandril 16. Further, the illustrated heating means can be arranged between the rollers 6 and 8 or the roller 6 can be ommittted. The mandril 16 of the illustrated embodiment is fully cylindrical. The necessary orientation of the plastics foil web relative to the paper web is obtained with the illustrated embodiment by the mutual positions of the storage reels and the guide rollers, although said orientation can also be obtained by means of separate guide means.

It is also possible to provide heating devices, for example the devices 9 and 10, so that the surface of the paper web coated with said plastics substance is heated directly.

I claim:

1. A method of manufacturing cylindrical tubes comprising the steps of: helically winding a high-density plastics foil web and at least one paper web on a rotating mandril, a side of the paper web which is adjacent the high-density plastics foil web being coated with a plastics substance which becomes tacky when heated, moving said paper web past a heat source, said heat source arranged to soften the plastics substance to said tacky state, contacting the high-density plastics foil web with the tacky surface of said paper web in a manner such that a first edge portion of the high-density plastics foil web projects at a substantially constant width outside one side edge of the paper web creating a laminar web formed by the high-density plastics foil web and the paper web, feeding said laminar web to a mandril with the plastics foil web in contact with a forming surface of said mandril, coating said first edge portion of the plastics foil web with a continuous bead of molten adhesive on the side opposite from said surface forming a laminar web, winding said paper web and said plastics foil web on said mandril at an angle such that the first edge portion is contacted with a second edge portion of said plastics foil web, and cooling said mandril during said winding process to a temperature so as to maintain at least said layer of high-density plastics foil nearest to the mandril at a temperature below the melting point of said foil.

2. A method according to claim 1, wherein the width of the plastics foil web is such as to completely cover said paper web.

3. A method according to claim 2, wherein the plastics foil web is pressed against the tacky surface of the paper web by means of guide devices arranged upstream of the mandril.

4. A method according to claim 1, wherein heat is applied to the surface of the paper web opposite the surface of said web having the layer of plastics material, thereby to soften said material.

5. A method according to claim 4, wherein a plurality of additional paper webs are helically wound on said paper web and are mutually joined together.

6. A method according to claim 4, wherein said edge portion of said plastics foil web is contacted with a heat conducting means prior to being wound on the mandril, thereby to maintain the temperature of said edge portion beneath the temperature of adjacent portions of said plastics foil web.

* * * * *